US008185974B2

(12) United States Patent
Mauduit

(10) Patent No.: US 8,185,974 B2
(45) Date of Patent: May 29, 2012

(54) TOILET WITH MAGNETIC ATTRACTION BETWEEN BEARING AND PIVOT

(75) Inventor: Daniel Mauduit, Mezeray (FR)

(73) Assignee: Daniel Mauduit, Chateau du Loir (FR)

( * ) Notice: Subject to any disclaimer, the term of this patent is extended or adjusted under 35 U.S.C. 154(b) by 767 days.

(21) Appl. No.: 12/281,363

(22) PCT Filed: Feb. 27, 2007

(86) PCT No.: PCT/FR2007/000349

§ 371 (c)(1),
(2), (4) Date: Oct. 31, 2008

(87) PCT Pub. No.: WO2007/099223

PCT Pub. Date: Sep. 7, 2007

(65) Prior Publication Data

US 2009/0064402 A1 Mar. 12, 2009

(30) Foreign Application Priority Data

Mar. 2, 2006 (FR) ..... 06 01871

(51) Int. Cl.
*A47K 13/12* (2006.01)

(52) U.S. Cl. ..... 4/236; 4/237; 4/240; 4/242.1

(58) Field of Classification Search ..... 4/236, 240, 4/237, 242.1

See application file for complete search history.

(56) References Cited

U.S. PATENT DOCUMENTS 3,550,164 A * 12/1970 Pease ..... 4/236
3,646,620 A * 3/1972 McCawley ..... 4/237
4,122,563 A * 10/1978 Johnson ..... 4/236
4,438,535 A * 3/1984 Paredes ..... 4/234
4,561,130 A * 12/1985 Bumgardner et al. ..... 4/253
4,747,167 A * 5/1988 Adams ..... 4/234
5,212,840 A * 5/1993 Caldwell ..... 4/237
5,361,425 A * 11/1994 Armanno, Sr. ..... 4/248
5,412,815 A * 5/1995 Ellis ..... 4/239
6,119,282 A * 9/2000 Serbin ..... 4/300.3
6,289,527 B1 * 9/2001 Truettner ..... 4/300.3
6,449,780 B1 * 9/2002 Merry ..... 4/239
7,485,166 B2 * 2/2009 Safuto ..... 55/385.1
D619,230 S * 7/2010 Cardenas ..... D23/311

FOREIGN PATENT DOCUMENTS

WO WO 2005/055792 A1 6/2005

* cited by examiner

*Primary Examiner* — Brian Glessner
*Assistant Examiner* — Joshua Ihezie
(74) *Attorney, Agent, or Firm* — Millen, White, Zelano, Branigan, P.C.

(57) ABSTRACT

The present invention relates to a toilet in which the bowl (1) has at least one bearing (4) with an open cross section, preferably a curved wall, particularly in the general shape of a C, against which is rotatably engaged at least one part forming a pivot (20) attached to a moving part such as a flap forming a lid, a seat or a urinal, characterized in that said pivot (20) and said bowl each comprise means of mutual magnetic attraction (6) so arranged that said moving part (2) can be moved between a lowered position resting on the bowl (1) or roughly parallel to the upper plane of the bowl, and a raised position, wherein said pivot (20) is engaged in said bearing (4), and this pivot (20) can be separated from said bearing (4) provided said moving part (2) is pulled strongly enough to overcome the force of magnetic attraction.

19 Claims, 5 Drawing Sheets

TOILET WITH MAGNETIC ATTRACTION BETWEEN BEARING AND PIVOT

This invention relates to toilets

These toilets are of a type in which the bowl has at least one open straight section bearing and, preferably, with a curved wall, in particular in the general "C" form, against which at least one part forming a journal is engaged in rotation, combined with a mobile element such as a lid forming a cover, a lavatory seat or a urinal, which said element can be moved between a low position, supported on the bowl or appreciably parallel to the upper plane of the bowl, and a raised position.

The document WO-A-2005/055792 describes toilets of this type.

Such a structure is entirely satisfactory, due to its simplicity and the facility with which the various elements of the toilets can be dismantled to be cleaned.

This type of toilet is particularly well adapted in an environment receiving the public, such as a train, where usually this type of equipment is subject to damage and even theft.

Here, due to the presence of a cistern supplied with a door that can be locked, the extraction and taking away of the lavatory seat and cover can only be carried out if one has the key.

This invention is intended to propose toilets with an even simpler structure, which are more specifically adapted to domestic use, that is, an environment in which the risks of damage and/or theft are non-existent.

Thus, this invention relates to toilets where the bowl has at least one open straight section bearing and, preferably, with a curved wall, in particular in the general "C" form, against which at least one part, forming a journal, is engaged in rotation, combined with a mobile element such as a lid forming a cover, a lavatory seat or a urinal, characterised by the fact that the said journal and the said bowl each have magnetic means of mutual attraction organised in such a way that the said mobile element can be moved between a low position supported on the bowl or appreciably parallel to the upper plane of the bowl and a raised position, while the said journal is engaged in the said bearing, and so that this journal can be separated from the said bearing while the said mobile element is subject to sufficient traction to overcome the magnetic attraction force.

Where it is indicated that the bowl has means of magnetic attraction, this indicates that the bowl itself, as well as any equipment that may hold it, may be provided with such means.

In accordance with the invention, the presence of magnetic means of attraction allows the toilet seat and lid to keep their initial function, while greatly facilitating their removal.

Preferably, the said means of mutual magnetic attraction are of the permanent magnet/permanent magnet or permanent magnet/ferromagnetic material type.

Thus, for example, a magnet or a series of magnets may be integrated in the bowl, while the toilet seat is entirely composed of ferromagnetic material, with a plastic coating that improves its comfort and cleaning.

Further, according to other characteristics that are advantageous but not exhaustive:

Where the mobile element consists of a toilet seat, this includes a lip that can immobilise it laterally in relation to the bowl, while it is supported on it;

The said journal includes a longitudinal cavity, with a circular arc section, in which is placed one of the said means of magnetic attraction, the rotational movement of this journal in relation to the bearing being carried out by a movement in relation to the said cavity with regard to the said means;

The said means of magnetic attraction are shaped so as to brake the movement of the mobile element during its passage from the high position to the low position;

The said means supported by the said bowl has a circular arc shape and is separated from the said bearing by a non-uniform distance;

The opposite ends of the said bearing are wedged between lateral cheeks and one of the means of magnetic attraction is placed in these cheeks;

The toilet includes two bearings that are not wedged against each other along their length or height, the lower bearing cooperating with the journal of a toilet seat, while the higher bearing cooperates with the journal of a lid;

Means of initiating the flush are associated with the said journal.

Other characteristics and advantages of the invention will appear upon reading the detailed description that will follow certain modes of production. This description, given non-exhaustively, shall be made with reference to the appended figures in which:

FIG. 1 appended hereto shows a toilet of the prior art;

Figure 1:
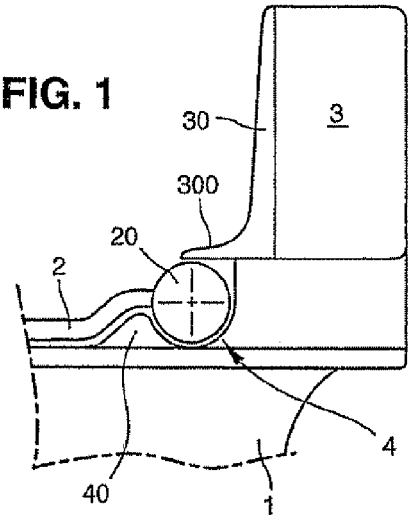

In relation to FIG. 1, the bowl (1) of the toilet is surmounted here, in its rear part, a cistern (3) equipped with a frontal door (30). The base of this door is shaped into a tongue (300) that projects forward. According to the described invention, the bowl (1) has a bearing (4) that has a single part with it. This bearing receives, upon rotation, the journal (20) of a mobile element (2) such as a rim or a lid (cover). This bearing has a front wing (40) that transversally cuts the whole breadth of the bowl. Due to the presence of the tongue (300) that projects, the journal is kept in the bearing. Thus, it can only be taken out if the door (30) is opened, that is, provided that the tongue no longer "closes" the bearing (4).

Figure 2:
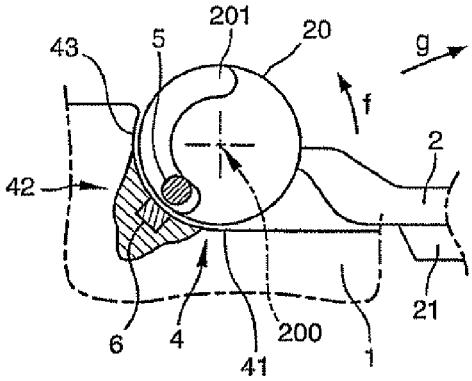
FIG. 2 is a partial and simplified view of toilets according to the invention, for which the toilet seat is shown here in the lower position.

In relation to FIG. 2, the bowl (1) of the toilet has been partially represented, in the part that receives a journal (20) combined with a toilet seat (2).

This part constitutes a bearing (4) for which the straight section is open and with a curved wall. More specifically, this bearing includes surfaces (41) and (43), respectively horizontal and vertical, linked by an intermediary curved surface (42) for which the radius of curvature is identical to that of the journal (20).

This bearing runs along the whole length of the bowl. However, in a form of production that is not represented, this bearing may be formed from distinct and aligned sections, separated by intermediary indented areas, which do not constitute support surfaces for the journal.

In the material of the bowl, showing on the curved surface (42), appreciably in its intermediate region, there is a magnetic means of attraction (6).

This can be, for example, a permanent magnet consisting of a bar in a single piece, which is housed in a groove provided for this purpose in the material of the bowl.

The journal (20), for which the rotational axis is referenced (200), consists of a cavity (201) in a longitudinal direction, with a circular arc section that is centered on the said axis (201).

In this cavity is placed another magnetic means of attraction (5), which has the shape of a circular section shank. Its diameter is slightly less than the breadth of the cavity (201), with some play. This shank, for example, consists of a permanent magnet or a Ferro-magnetic material.

It can be easily understood that while the journal (20), with its associated shank (5) is sufficiently close to the bearing, the shank (5) is immobilised in relation to the magnet (6) due to the magnetic attraction phenomenon.

However, the possibility of rotating the journal (20) in relation to the bearing (4) is maintained, this being done by moving the cavity (201) in relation to the shank (5).

In other words, during the rotation movement of the journal around its own axis, it is the cavity (201) that moves in relation to the bearing (5).

Figure 3:
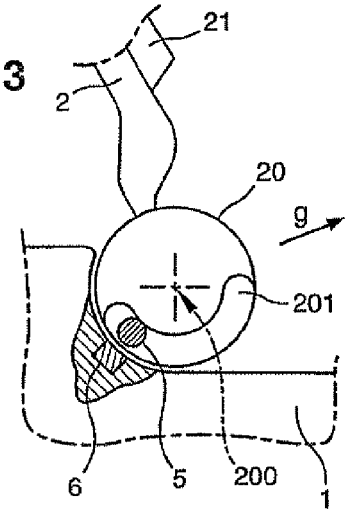
FIG. 3 is a view analogous to FIG. 2, the toilet seat being shown in the upper position.

One can therefore easily go from the low position of FIG. 2, in which the toilet seat (2) is supported on the bowl (1), to the raised position in FIG. 3, by a rotational movement of at least 90° around the axis of the journal, as shown by the Arrow f.

However, where the toilet seat (2) is subjected to a traction movement (Arrow g in FIGS. 2 and 3) that is sufficient to overcome the magnetic force of attraction between the magnet (6) and the shank (5), it is then possible to separate it from the bearing.

It can therefore be accessed, for example, to clean it, which is particularly easy due to the presence of a curved surface, without recesses.

In a form of production that is not represented, the magnet (6) is not directly visible at the surface of the bearing. It may be hidden from view by a protective covering, for example.

In another variation that is not represented, the magnet is integrated in another location of the bowl or in one of its fittings, the important thing being that the magnetic attraction force should be sufficient vis-à-vis the means carried by the journal.

As is visible in these two figures., the toilet seat (2) has a lip (21) that has the function of ensuring the lateral support of this toilet seat in relation to the bowl (1). For further explanations, reference can be made to FIGS. 13A and 13B in which this lip has the reference 22.

Figure 4:
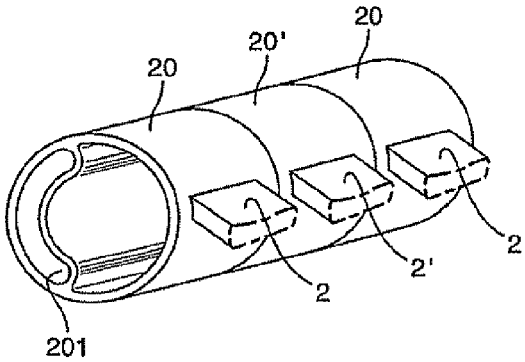
FIG. 4 is a view from a perspective of contiguous journals, connected in relation to a toilet seat and lid that form a cover.

In FIG. 4 is represented a form of production in which the toilet seat (2) is connected to two distinct journals (20), which frame an analogous 20' journal combined with a lid that forms a 2' cover.

These are well-hollowed cylinders, in which the above-mentioned cavity (201) is delimited by a supplementary surface.

Preferably, a single shank (5) is engaged in the cavity of these three aligned and contiguous journals.

Figure 5:
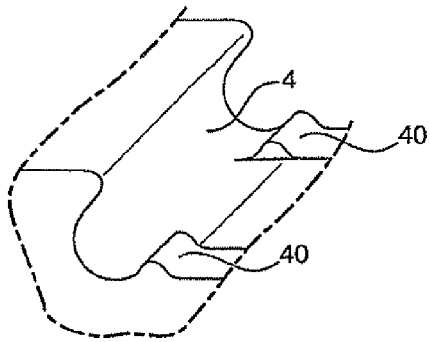
FIG. 5 is a view from a perspective of a particular form of bowl bearing.

FIG. 5 shows a form of production of the bearing (4) that is delineated in its front part, that is, the basin of the bowl (1) by two wings (40) that confer on it a straight section in the form of a "C".

In another form of production, these two wings could be joined to constitute a single and continuous protuberance.

The presence of these wings allows the journal(s) to be "supported", particularly by preventing any unwanted removal of the toilet seat or cover.

Furthermore, such a structure, when one is dealing with several journals, as shown in FIG. 4, allows these to be perfectly aligned with one another.

Figure 6:
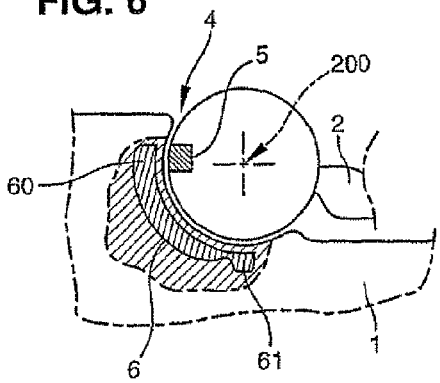
FIG. 6 is a view analogous to FIG. 2, showing another form of production of the means of magnetic attraction.

In FIG. 6 there is a structure similar to that presented in FIG. 2.

However, in this figure the journal (20) does not have a cavity (201). Nevertheless, a magnetic means of attraction is integrated, consisting of, for example, a magnet (5) in the form of a shank with a squared section In the body of the bowl there is another means of magnetic attraction (6) also consisting of a magnet, for example.

As the figure shows, this magnet has the form of a circular arc that has a curve similar to that of the bearing (4).

However, the magnet is shaped in such a way as to brake the movement of the toilet seat (2) during its passage from the raised position shown in this figure to the low position, in which it is supported against the bowl.

This "braking" prevents any sudden passage from one position to the other, which normally results from an inadvertent movement and that generates noise.

To do this, the section of the magnet progressively diminishes from its upper extremity (60) to its lower extremity (61), it being understood that the section at this lower extremity is again more than ample.

Thus, in the raised position of the toilet seat, the magnet 5 is provided at the center of gravity of the extremity (61).

As one presses on the toilet seat in a movement going downwards, the magnet 5 is progressively situated opposite a region of the magnet where the section progressively increases and, likewise, the magnetic force.

It is therefore necessary to provide an increasing effort to lower the toilet seat.

Other forms of production that allow the same aim to be achieved can be envisaged.

Thus, in one variation that is not represented, one can have a magnet (6) in a circular arc with a constant section, but in which the gap in relation to the bearing (20) varies. There, where the gap in relation to the bearing is greater, the magnetic force of attraction is less.

Figure 7:
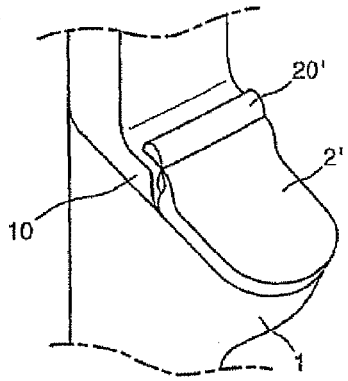
FIG. 7 is a schematic view from a perspective of a toilet that complies with the invention, the journal of the lid being lodged lengthwise by cheeks that form a stop.

In the form of production set out in FIG. 7, the journal (20') of the cover (2') is "imprisoned" between two flanks (10) that form part of the bowl. This prevents any lateral movement of the journal (that is, along the longitudinal axis) in relation to its associated bearing.

Figure 8:
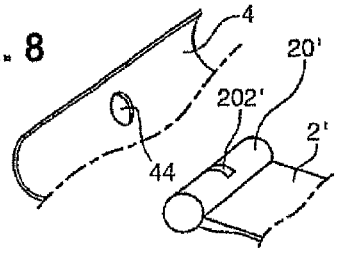
FIG. 8 is also a view from a perspective of a particular form of production of a bearing and of an associated journal.

With reference to FIG. 8, one is again dealing with means that prevent any lateral movement of the journal (20') in relation to the bearing (4).

The means used here consist, on the one hand, of a sprocket that projects from the surface of the bearing and, on the other, of a supplementary groove (202') formed in the body of the journal (20'). It can be seen that while the sprocket (44) is engaged in the groove (202), any lateral movement in relation to the two parts is impossible.

Figure 9:
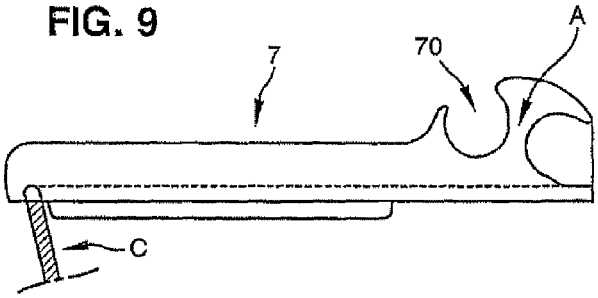
FIG. 9 is an exploded view from the side of a cover part supported by the toilet bowl and an anchoring part constituting the base of a reservoir, this figure serving to show another possible implantation of the means of magnetic attraction.
Figure 9:
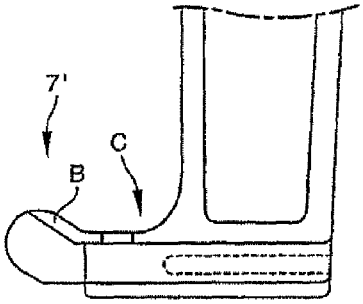

FIG. 9 represents a structure that is elsewhere described in French patent request No. 06 00022 of 2 Jan. 2006, in the name of this applicant.

This concerns a piece (7) that is described as a "cover piece", that is planned to come positioned on a casing C that conceals the toilet bowl. This piece has a bearing (70) to receive the journal of a toilet seat and/or cover. This piece is associated with an "anchorage piece" that constitutes the base of a water reservoir.

The arrows A, B and C show the possible implantations of the magnetic means of attraction (6), the distance of these in relation to the journal requiring that this force of attraction should increase as this distance gets greater.

Figure 10:
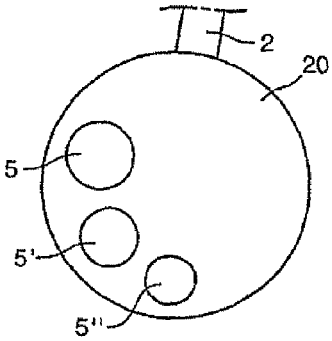
FIG. 10 is the end view of a journal associated to a toilet seat or to a lid, with magnets of various sizes implanted in it.
Figure 11:
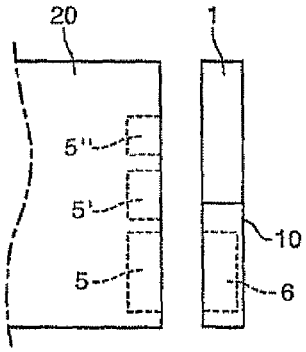
FIG. 11 is a partial view, from above, of the journal in FIG. 10 and an end stop in relation to which the journal moves.
Figure 12:
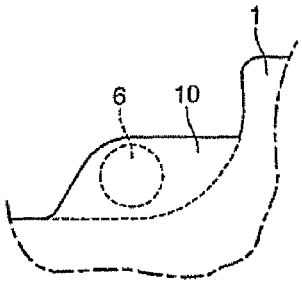
FIG. 12 is a front view of the said stop.

In FIGS. 10 and 11 there is a representation of the journal (20) of a toilet seat (2) in the extremities of which there is provision for three circular magnets (5), (5') and (5"), with different diameters.

This journal is intended to be mounted between the flanks (10) analogous to those shown in FIG. 7.

Another magnet (6) is integrated into these. In these conditions, the flanks contribute not only to the lateral immobilisation of the journal (20). The also provide the magnetization of this journal in relation to the flanks.

The fact that it has three magnets of different sizes allows it to fulfill the same function as that described in FIG. 6, in relation to the magnet (6).

Figure 13A:
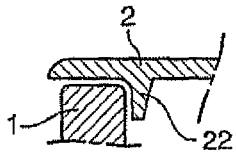
FIGS. 13A and 13B are section views intended to illustrate two possible positions of the toilet seat in relation to the bowl of the toilet.
Figure 13B:
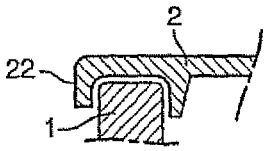

FIGS. 13A and 13B partially represent two forms of production of the toilet seat (2) supported on the upper rim of the bowl (1). In order to laterally stabilize this toilet seat in relation to the bowl, it has a lip (22) that connects to its underside and that is planned to come to rest either against the internal rim of the edge of the bowl (FIG. 13A) or against the external rim (FIG. 13B). Thus, when a person is sitting on the toilet seat, any attempt at lateral movement is prevented by the presence of this lip, which "stabilises" the toilet seat in relation to the bowl. It may be continuous or discontinuous.

Figure 14:
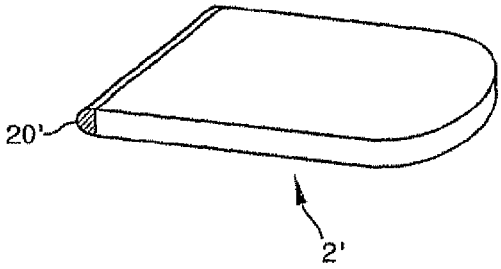
FIG. 14 is a perspective view of a possible production shape of a toilet cover.

FIG. 14 shows a variation of a cover (2') in which the journal is not constituted in the form of a cylinder, but a demi-cylinder (20') cut longitudinally. This journal is, for example, made of ferromagnetic metal and is fixed to the body of the cover (2').

For reasons of protection, aesthetics and ease of cleaning, the unit may be coated in a plastic "skin", not represented.

If needed, the journal may be flanked by two end shanks, which can constitute means of blocking the journal according to its longitudinal axis, in relation to the bowl.

Figure 15:
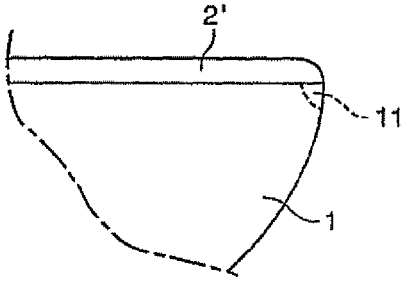
FIGS. 15 and 16 are, respectively, side and front views of a toilet bowl, the shape of which is planned to facilitate the raising and removal of the cover and toilet seat.
Figure 16:
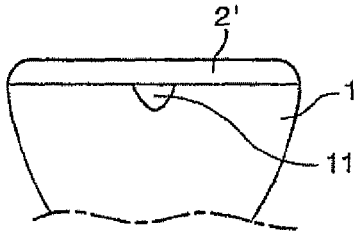

FIGS. 15 and 16 partially show a bowl (1) according to the invention, in which the basin has, at its front surface and communicating with its upper edge, a small cavity (11). The size of this cavity is sufficient to introduce some fingers and thus be able to catch hold of the front part of the cover (2') in order to separate it from the bowl.

Figure 17:
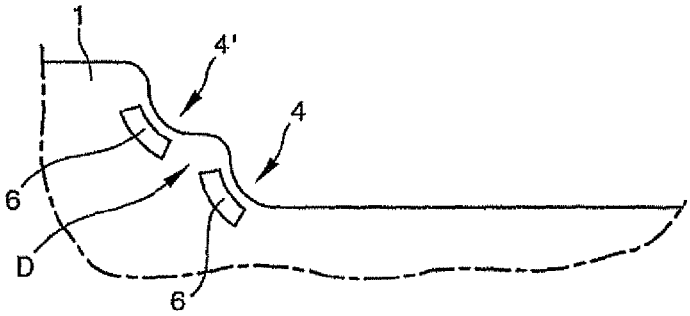
FIG. 17 is a simplified outline showing, from the side, the upper part of the bowl intended to receive the journals of the toilet seat and cover.
Figure 18:
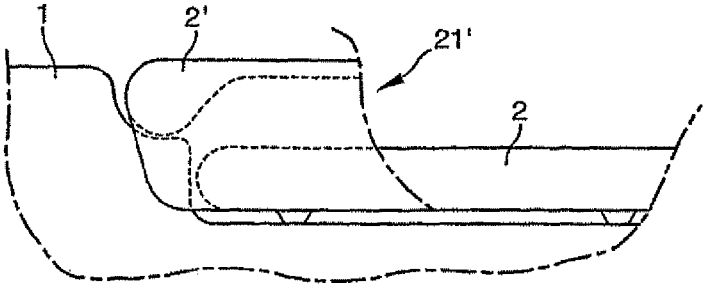
FIG. 18 is a view equivalent to the previous figure, with the cover and toilet seat partially represented.

FIGS. 17 and 18 show a form of production of the bowl in which there are two bearings (4) and (4'), which move in relation to each other both in height and length, the lower bearing (4) cooperating with the journal of a toilet seat (2), while the higher bearing (4') cooperates with the journal of a cover (2').

As is shown in FIG. 17, each bearing is associated with a magnetic means of association (6). However, in a form of production that is not represented, one could have a single means of attraction, placed judiciously in relation to the two bearings. A particularly suitable placement is that indicated by the arrow D in this figure.

In FIGS. 18 to 21 one can see the toilet seat and cover (2') that cooperate with these bearings.

The journals (20) and (20') that equip these each have a magnetic means of attraction (5) and form a demi-cylinder.

The cover includes, on its under-side, a peripheral flange (22') pointed downwards, that is planned to rest and to be supported on the toilet seat (2). A protective pad is placed against the flange.

Figure 21:
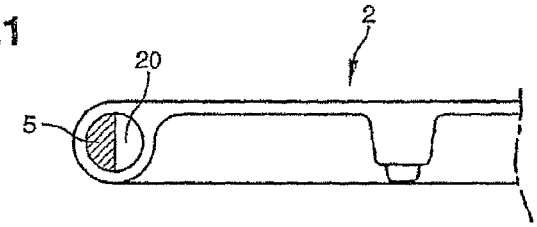
FIG. 21 is a view analogous to FIG. 19, showing the toilet seat.

As FIG. 21 shows, the toilet seat is shaped in an analogous manner, the flange that it includes supported on the perimeter of the basin of the bowl.

Figure 19:
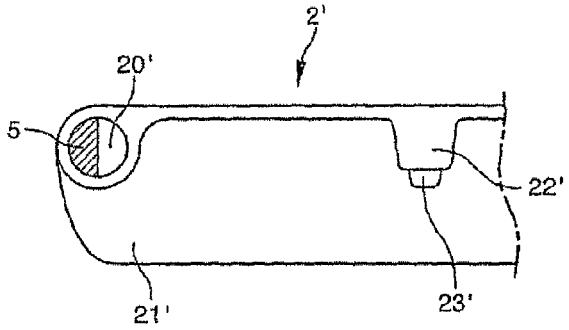
FIG. 19 is a partial view, according to a vertical and longitudinal section, of the said cover.
Figure 20:
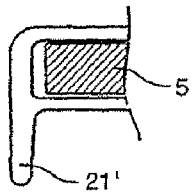
FIG. 20 is also a partial section view, according to a section perpendicular to the previous one, passing through the center of the journal.

As can be seen in FIGS. 18 and 19, the cover (2') includes a peripheral skirt (21') that is directed downwards and that is sufficiently low to hide the toilet seat while both are in the low position (position of the FIG. 18).

Figure 22:
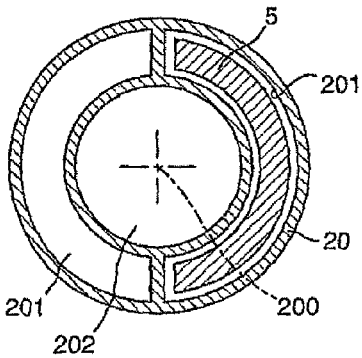
FIG. 22 is a transversal section of one end of a journal.

The journal (20) shown in FIG. 22 is compartmentalized. It includes two circular arc cavities that demarcate a third central and cylindrical cavity (202). In one of the cavities is placed a magnetic means of attraction (5).

The two cavities (201) are closed and are stopped upon withdrawal of the end of the journal such that, longitudinally, one is dealing with a change of section.

Figure 23:
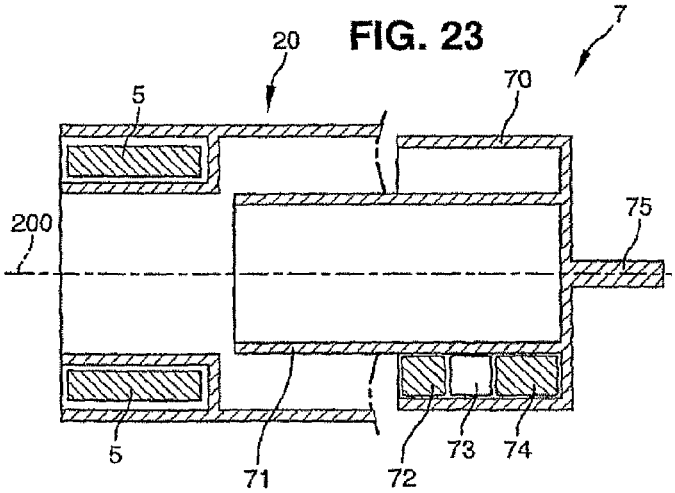
FIG. 23 is a section view, but this time longitudinal from the end of the journal of the preceding figure, and of a command part that this end is intended to receive.

This open end receives a control piece (7) represented on the right part of FIG. 23.

It includes a cylindrical part (71) that is shaped to engage by sliding in the central cavity (202) of the journal. It opens at one end and closes at the other.

The central cylinder is surrounded by a cylindrical skirt (70) opened from the same side as the central cylinder.

In this skirt are engaged, from the bottom to the opening, a magnetic attraction piece (74), a non-magnetic piece (73) and another magnetic attraction piece (72).

The piece (7), moreover, has a manoeuvre part (75).

By sliding, one engages the part (71) in the central cavity (202) of the journal (20). By doing this, the means (5) draws the piece (72) by magnetic attraction.

Thus, the piece (7) is perfectly positioned in relation to the journal. By doing this, and because of the piece (73), the magnetic means of attraction (74) does not come under the influence of pieces (5) and (72).

By manoeuvring the manoeuvre part (75), the piece can undergo an partial rotation around the axis (200) of the journal, in such a way as to lead the piece (74) into a particular angular position.

This particular position allows one, for example, to render operational a system for operating the flush, removing smells, etc.

The piece (7) is not necessarily kept in the journal by a system of magnets. One can, for example, use clipping and other means.

According to the same principle, the piece (7) may integrate a radio, etc.

Figure 24:
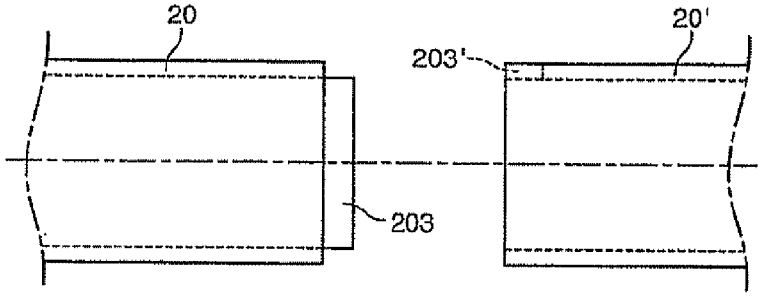
FIG. 24 is a partial view, from above, of two contiguous journals equipped with means that allow their alignment to be maintained.

FIG. 24 shows two contiguous journals (20) and (20'). In order to ensure their perfect alignment in relation to one another, the journal (20) has an anchoring sprocket (203) that is planned to slip into the mouth of the journal (20').

Figure 25:
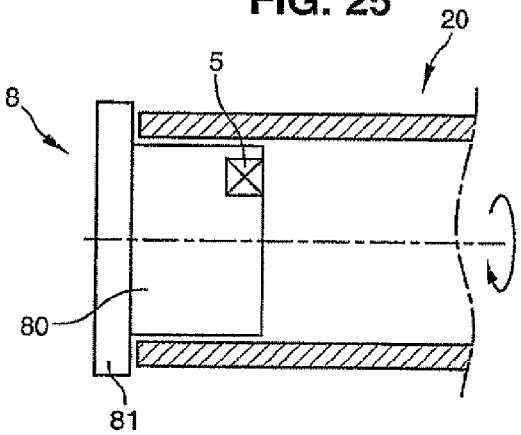
FIGS. 25 and 26 are partial section views of journals with closing caps.

In FIG. 25, the journal (20) consists of a hollow cylinder. Its ends receive (only one is visible in the figure) a stopping plug. Its body (80) presents sufficient dimensions to be fitted, with little give, in the journal. A magnetic means of attraction (5) is included in it.

To this body is attached a disk (81) that constitutes, in a way, the head of the plug. This disk has a diameter greater than the external diameter of the journal (20).

Thus, when the journal is positioned on the corresponding bearing, it is the periphery of the disk 81 that is supported on the bearing, whereas the journal can be moved by rotation in relation to the plug.

One thereby avoids premature wear and tear of the journal.

Figure 26:
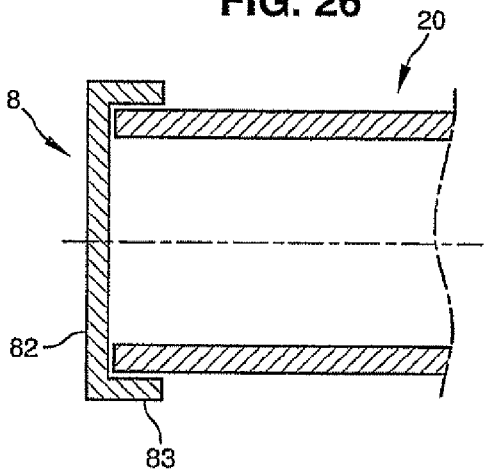

In the variation appearing in FIG. 26, the plug (8) consists of a disk (82) extended by a flange (83) that is applied against the external surface of the journal (20). Here, it is the peripheral surface of the flange (83) that comes into contact with the bearing.

Figure 27:
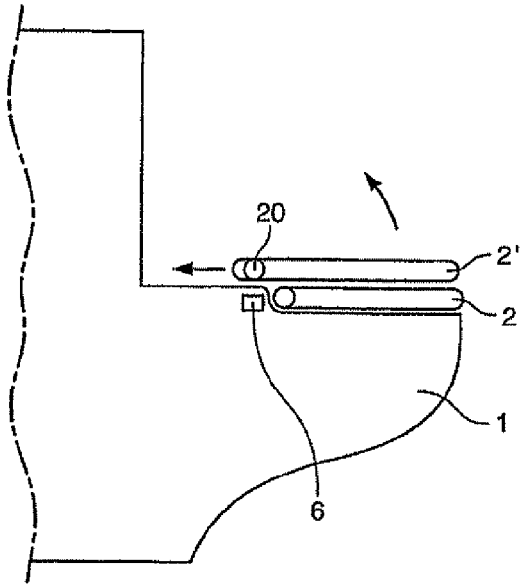
FIG. 27 is a schematic view of a toilet for which the cover may be moved, depending on choice, by sliding or by rotation.

In FIG. 27, the bowl (1) has a toilet seat (2) and a cover (2') with staggered bearings. The cover is planned to be hollow and the journal (20') that equips it is mounted on the inside, so that they can be moved in relation to each other. In this way, the cover may be raised up in the traditional manner. However, it can also be moved horizontally, by sliding, provided that one has sufficient space to accommodate it.

In a variation that is not represented, this sliding may be carried out laterally.

The invention claimed is:

1. A toilet comprising a bowl (1) having at least one bearing (4, 4') with an open straight section and a curved wall, against which rotation is engaged by at least one piece forming a journal (20, 20'), combined with at least one mobile element comprising a flap forming a cover (2'), a toilet seat (2) or a urinal, wherein said journal (20, 20') and said bowl each have mutual magnetic means of attraction (5, 5', 5"; 6) that are encased in said journal and said bowl and are capable of providing a hingeless connection between said journal and said bowl and arranged so that said mobile element (2, 2') is movable between a low position supported on the bowl (1) or appreciably parallel to an upper plane of the bowl (1) and a raised position, while said journal (20, 20') is engaged in said bearing (4, 4'), and the journal (20, 20') is separable from said bearing (4, 4') when said mobile element is subject to sufficient traction to overcome the magnetic force of attraction.

2. A toilet according to claim 1, wherein said mutual magnetic means of attraction (5, 5', 5"; 6) comprise permanent magnet/permanent magnet or permanent magnet/ferromagnetic material.

3. A toilet according to claim 1, wherein the mobile element comprises a toilet seat (2), including a lip (21, 22) that is able to immobilise said toilet seat laterally in relation to the bowl (1) on which said toilet seat is supported.

4. A toilet according to claim 1, wherein said journal (20) has a longitudinal cavity (201), with a circular arc section, in which is placed one of said means of magnetic attraction (5), the said journal (20) being capable of rotational movement in relation to the bearing (4) by the relative movement of said cavity in relation to the said magnetic attraction means (5).

5. A toilet according to claim 1, wherein said means of magnetic attraction (6) are shaped so as to brake movement of the mobile element (2, 2') during passage from the raised position to the low position.

6. A toilet according to claim 5, wherein said means of magnetic attraction (6) carried by the said bowl (1) has a circular arc form and a non-uniform straight section.

7. A toilet according to claim 5, wherein said means of magnetic attraction (6) carried by the said bowl (1) has a circular arc form and is separated from the said bearing by a non-uniform distance.

8. A toilet according to claim 1, wherein opposite ends of the said bearing are supported between the lateral flanks (10) and one of said magnetic means of attraction (6) is placed in these at least one of said flanks (10).

9. A toilet according to claim 1, including two bearings (4, 4') that are out of line with each other both in height and length, a lower bearing (4) cooperating with the journal (20) of a toilet seat (2), while a higher bearing (4') cooperates with the journal of a cover (2').

10. A toilet according to claim 1, comprising the means (7) of starting the flush are-operatively associated with said journal (20).

11. A toilet according to claim 1, wherein said curved wall is of a general "C" form.

12. A toilet according to claim 9, wherein said mutual magnetic means of attraction (5, 5', 5"; 6) comprise permanent magnet/permanent magnet or permanent magnet/ferromagnetic material.

13. A toilet according to claim 9, wherein the mobile element comprises a toilet seat (2), including lip means (21, 22) able to immobilise said toilet seat laterally in relation to the bowl (1) on which said toilet seat is supported.

14. A toilet according to claim 9, wherein said journal (20) has a longitudinal cavity (201), with a circular arc section, in which is placed one of said means of magnetic attraction (5), the said journal (20) being capable of rotational movement in relation to the bearing (4) by the relative movement of said cavity in relation to the said magnetic attraction means (5).

15. A toilet according to claim 9, wherein said means of magnetic attraction (6) are shaped so as to brake movement of the mobile element (2, 2') during passage from the raised position to the low position.

16. A toilet according to claim 9, wherein said means of magnetic attraction (6) carried by the said bowl (1) has a circular arc form and a non-uniform straight section.

17. A toilet according to claim 9, wherein said means of magnetic attraction (6) carried by the said bowl (1) has a circular arc form and is separated from the said bearing by a non-uniform distance.

18. A toilet according to claim 9, wherein the means (7) of starting the flush are operatively associated with said journal (20).

19. A toilet according to claim 9, wherein said curved wall is of a general "C" form.

* * * * *

UNITED STATES PATENT AND TRADEMARK OFFICE

CERTIFICATE OF CORRECTION

PATENT NO. : 8,185,974 B2
APPLICATION NO. : 12/281363
DATED : May 29, 2012
INVENTOR(S) : Daniel Mauduit It is certified that error appears in the above-identified patent and that said Letters Patent is hereby corrected as shown below:

In the Claims:

Column 8, line 21 (Claim 8), reads: "these at least one of said flanks (10)."
It should read: -- at least one of said flanks (10). --

Column 8, line 28 (Claim 10), reads: "of starting the flush are-operatively associated with said jour-"
It should read: -- of starting the flush operatively associated with said jour- --.

Signed and Sealed this
Second Day of October, 2012

David J. Kappos

David J. Kappos
*Director of the United States Patent and Trademark Office*